US006866157B2

(12) United States Patent
Shone

(10) Patent No.: US 6,866,157 B2
(45) Date of Patent: Mar. 15, 2005

(54) ACCESSORY SHELF UNIT FOR USE WITH TOWEL RAIL

(76) Inventor: Philip J. Shone, 1725 Redbud Way, Cumming, GA (US) 30041

( * ) Notice: Subject to any disclaimer, the term of this patent is extended or adjusted under 35 U.S.C. 154(b) by 16 days.

(21) Appl. No.: 09/928,606

(22) Filed: Aug. 13, 2001

(65) Prior Publication Data

US 2003/0029821 A1 Feb. 13, 2003

(51) Int. Cl.[7] ..... A47F 5/08

(52) U.S. Cl. ..... 211/90.03; 211/90.04; 211/86.01; 211/105.1

(58) Field of Search ..... 211/90.03, 90.01, 211/90.04, 86.01, 105.1, 88.01, 119.009, 119.011, 181.1, 118.008, 119.003; 108/42; 248/214, 241–243, 249; D6/524, 525, 536–537, 540, 546–550, 566

(56) References Cited

U.S. PATENT DOCUMENTS

| | | | | | |
|---|---|---|---|---|---|
| 442,498 | A | * | 12/1890 | Tennison | 211/119.003 |
| 846,359 | A | * | 3/1907 | Sparmaker et al. | 248/241 |
| 1,039,694 | A | * | 10/1912 | Burton | 211/90.04 |
| 1,201,595 | A | * | 10/1916 | Kraemer | 211/118.008 |
| 1,576,034 | A | * | 3/1926 | Butt | 211/119.003 |
| 1,607,887 | A | * | 11/1926 | Fowler | 248/241 |
| 2,612,273 | A | * | 9/1952 | Smith | 211/105.1 |
| 3,096,731 | A | * | 7/1963 | Lehman | 211/119.003 |
| 3,186,559 | A | * | 6/1965 | Glowa | 211/150 |
| 4,233,911 | A | * | 11/1980 | Vignale | 108/30 |
| 4,387,811 | A | | 6/1983 | Ragir et al. | |
| D292,256 | S | | 10/1987 | Chap | |
| 4,713,949 | A | * | 12/1987 | Wilcox | 108/102 |
| 4,777,888 | A | * | 10/1988 | Waterman et al. | 108/108 |
| 4,799,432 | A | * | 1/1989 | Rickner | 108/42 |
| 4,827,849 | A | * | 5/1989 | Vignale | 108/29 |
| 4,848,610 | A | * | 7/1989 | Lai | 108/152 |
| D313,957 | S | * | 1/1991 | Martinell et al. | D12/115 |
| D315,840 | S | | 4/1991 | Emery | |
| D320,134 | S | | 9/1991 | Emery | |
| 5,125,517 | A | * | 6/1992 | Martinell | 211/17 |
| 5,169,010 | A | * | 12/1992 | Fortner | 211/181.1 |
| 5,181,621 | A | * | 1/1993 | Plaehn | 211/119.011 |
| 5,255,401 | A | * | 10/1993 | Sambrookes et al. | 206/77.1 |
| D351,750 | S | | 10/1994 | Sweeney | |
| D367,791 | S | | 3/1996 | Emery et al. | |
| D368,614 | S | | 4/1996 | Munoz | |
| D370,810 | S | | 6/1996 | Munoz | |
| D377,286 | S | | 1/1997 | Munoz | |
| D378,556 | S | | 3/1997 | Munoz | |
| 5,711,434 | A | * | 1/1998 | Adams | 108/42 |
| 5,713,404 | A | * | 2/1998 | Ladewig | 108/42 |
| 5,921,410 | A | | 7/1999 | Emery et al. | |

* cited by examiner

*Primary Examiner*—Jennifer E. Novosad
(74) *Attorney, Agent, or Firm*—Baker, Donelson, Bearman, Caldwell & Berkowitz

(57) ABSTRACT

An accessory shelf unit for use with a towel rail in which the unit includes (a) at least two shelves and (b) at least two locking bars which engage the towel rail and secure the unit against a wall to which the towel rail is attached.

7 Claims, 3 Drawing Sheets

ACCESSORY SHELF UNIT FOR USE WITH TOWEL RAIL

TECHNICAL FIELD

This invention relates to an accessory shelf unit. In a more specific aspect, this invention relates to an accessory shelf unit for use with a towel rail.

BACKGROUND OF THE INVENTION

A common device in the household of today is a shelf unit for holding various items for use in the bathroom, especially in a bathtub or shower area. These units have been manufactured to hold shampoos, various cream and lotion products, wash cloths, shaving products, conditioners, etc.

Of course, the units must be readily accessible when these items are needed during the bathing process. Consequently, many units have been designed to fit over or attach to the extension arm between the wall and a shower head. A unit of this type is disclosed in U.S. Pat. No. 4,387,811 (1983).

Other designs have been developed for these shelf units. For example, U.S. Pat. No. 5,921,410 (1999) discloses a collapsible shelf unit which can be attached to a conventional towel rack, hand rail or the like.

However, the prior art units have one or more disadvantages, such as inadequate storage for certain items or lack of structural integrity. In addition, some of the "shower head" units require the user to reach through the shower spray to obtain the desired item.

Thus, there is a need in the industry for an effective and reliable accessory shelf unit for holding various items, especially in a bathtub or shower area.

SUMMARY OF THE INVENTION

Briefly described, the present invention provides an accessory shelf unit adapted for use with a towel rail. The present invention provides an accessory shelf unit which can be used to hold various items.

As will be seen in greater detail below, this invention provides an accessory shelf unit having advantages and benefits over the prior art.

Accordingly, an object of this invention is to provide an accessory shelf unit.

Another object of this invention is to provide an accessory shelf unit for use with a towel rail.

Another object of this invention is to provide an accessory shelf unit for use with a towel rail in a bathroom.

Still another object of this invention is to provide an accessory shelf unit for use with a towel rail, wherein the accessory shelf unit provides an equivalent amount of space for hanging as provided by the towel rail.

Another object of this invention is to provide an accessory shelf unit to hold various items, such as shampoos, cream and lotion products, wash cloths, shaving products and conditioners.

Still another object of this invention is to provide an accessory shelf unit which does not attach to the extension arm of a shower head assembly.

Still another object of this invention is to provide an accessory shelf unit for use with a towel rail so that the user is not required to reach through the shower spray to obtain an item held by the unit.

Still another object of this invention is to provide an accessory shelf unit which has structural integrity and which is adapted for use with a towel rail.

These and other objects, features and advantages of this invention will become apparent from the following detailed description.

DETAILED DESCRIPTION OF THE INVENTION

The present invention relates to a shelf unit which is three-dimensional and which is adapted for use with a towel rail attached to a wall, wherein the unit comprises (A) a rectangular back portion comprising a plurality of spaced apart horizontal bars and a plurality of spaced apart vertical bars, wherein a first end of each horizontal bar is attached at a substantially 90° angle to a first end of each vertical bar and a second end of each horizontal bar is attached at a substantially 90° angle to a second end of each vertical bar, the back portion being in contact with the wall; (B) at least two shelves, each of which is attached to and extends from the back portion at a substantially 90° angle, wherein the shelves extend away from the wall; (C) at least two locking bars adapted to engage the towel rail at points between the towel rail and the wall, wherein each locking bar is attached to and extends from a vertical bar at a substantially 45° angle, the locking bars extending away from the wall; and (D) a rectangular bottom portion attached to a lowermost portion of the vertical bars and extending from the vertical bars at a substantially 45° angle and extending away from the wall.

Figure 1:
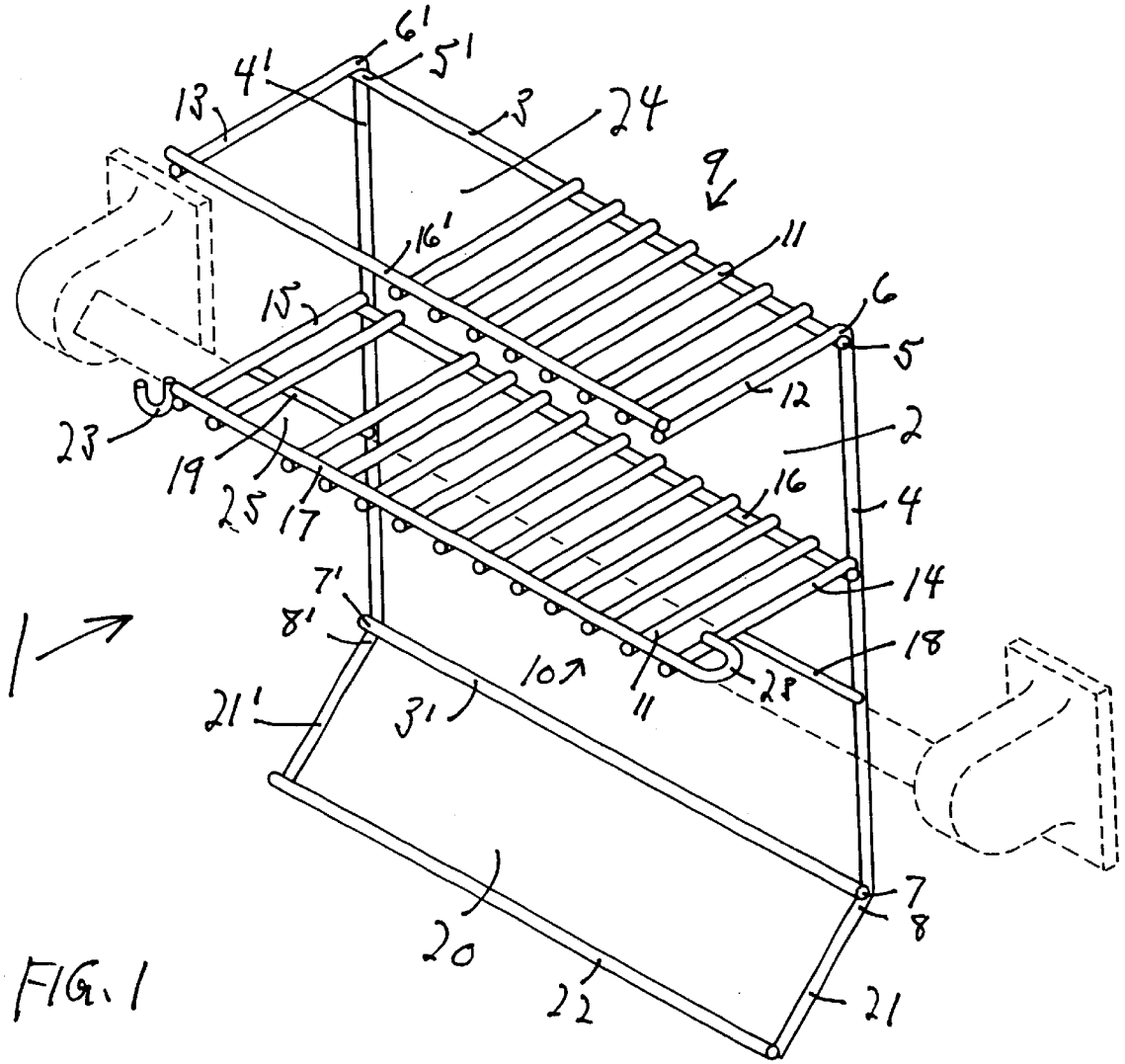
FIG. 1 is a perspective view of the accessory shelf unit of this invention, with a towel rail shown in phantom lines.

A preferred configuration of the shelf unit of the present invention is shown in FIG. 1.

Referring now to the drawings, in which like numbers represent like elements, FIG. 1 shows a preferred embodiment of this invention in which a shelf unit 1 comprises a rectangular back portion generally shown at 2. The back portion is formed by a pair of parallel spaced apart horizontal bars 3 & 3' and a pair of parallel spaced apart vertical bars 4 & 4'. The horizontal bars have first ends 5 & 5', while the vertical bars have first ends 6 & 6'. Additionally, the horizontal bars have second ends 7 & 7', while the vertical bars have second ends 8 & 8'.

In FIG. 1, the first ends 5 & 5' of the horizontal bars are attached at substantially 90° angles to the corresponding first ends 6 & 6' of the vertical bars. Similarly, the second ends 7 & 7' of the horizontal bars are attached at substantially 90° angles to the corresponding second ends 8 & 8' of the vertical bars. Preferably, the horizontal bars are parallel to each other, as are the vertical bars. Additional horizontal and/or vertical bars can be used in the shelf unit of this invention.

The back portion 2 is preferably in contact with the wall (not shown in the drawings) on which the towel rail is attached. (The towel rail is shown in the drawings in phantom lines but is not a part of this invention.)

Extending from the back portion 2 at substantially 90° angles are two shelves generally shown at 9 & 10. These shelves extend away from the wall on which the towel rail is attached. As shown in FIG. 1, these shelves comprise a plurality of spaced apart rods 11 which are parallel to each other on shelves 9 and 10. Additionally, shelf 9 is preferably parallel to shelf 10. The ends of the shelves are defined by bars 12 & 13 (shelf 9) and bars 14 & 15 (shelf 10). The ends (closest to the wall) of the bars 12 & 13 are attached at substantially 90° angles to horizontal bar 3, and the ends (closest to the wall) of the bars 14 & 15 are attached at substantially 90° angles to a third horizontal bar 16 which is attached at similar angles to vertical bars 4 & 4'.

Similarly, the other ends of the bars 12 & 13 (shelf 9) and bars 14 & 15 (shelf 10) are attached at substantially 90° angles to additional horizontal bars 16' & 17. Additional bar 16' is attached at similar angles to bars 12 & 13. Additional bar 17 is attached at similar angles to bars 14 & 15. Horizontal bar 16 is also attached at similar angles to bars 14 & 15 and to shelf rods 11. Horizontal bar 17 is also attached at similar angles to bars 14 & 15 and to shelf rods 11.

Preferably, as shown in FIG. 1, the horizontal bars 16' & 17 are attached to the top of bars 12 & 13, 14 & 15 and shelf rods 11. This configuration provides a "stop" position on each of the shelves to prevent items from sliding off the shelves. Alternatively, one or more of the shelves may be slanted to prevent items from sliding off the shelves. Additionally, shelf 9 may have an opening (generally shown at 24) which coordinates with a smaller opening (generally shown at 25) in shelf 10 to provide space for containers of shampoo, conditioner and the like to be placed in an upside down position for ease of dispensing the contents of such containers. This feature may be referred to as a "shampoo saver", which is especially useful for dispensing the final contents of a container of shampoo, etc.

Although shown with spaced apart shelf rods 11, the shelves 9 & 10 can be single solid pieces of suitable materials, such as aluminum, steel, plastic, vinyl covered metal, chrome-plated metal, etc.

As shown in FIG. 1, either end of the bar 17 can be finished with a hook or similar feature (generally shown at 23 and 23') which can be used for holding various items, such as wash cloths, hand razors, etc.

Referring again to FIG. 1, the shelf unit of this invention includes at least two locking bars 18 & 19 which are attached at substantially 45° angles to vertical bars 4' & 4, respectively, and to shelf end bars 14 & 15, respectively. These locking bars are essential to this invention and enable the shelf unit 1 to become secure between the towel rail and the wall to which the towel rail is attached. With substantially 45° angles, the locking bars 18 & 19 extend away from the wall and are effective with towel rails of any shape and size. Of course, additional locking bars can be used.

The shelf unit of this invention, as shown in FIG. 1, also includes a rectangular bottom portion 20 which extends away from the wall to which the towel rail is attached. Additionally, the side bars 21 & 21' of the bottom portion 20 are attached at substantially 45° angles to the ends of the horizontal bar 3' and vertical bars 4 & 4'. Preferably, the bottom portion 20 is open, so that a towel or wash cloth can be hung over the bottom bar 22. In this way, towel space is not lost from the towel rail.

Figure 2:
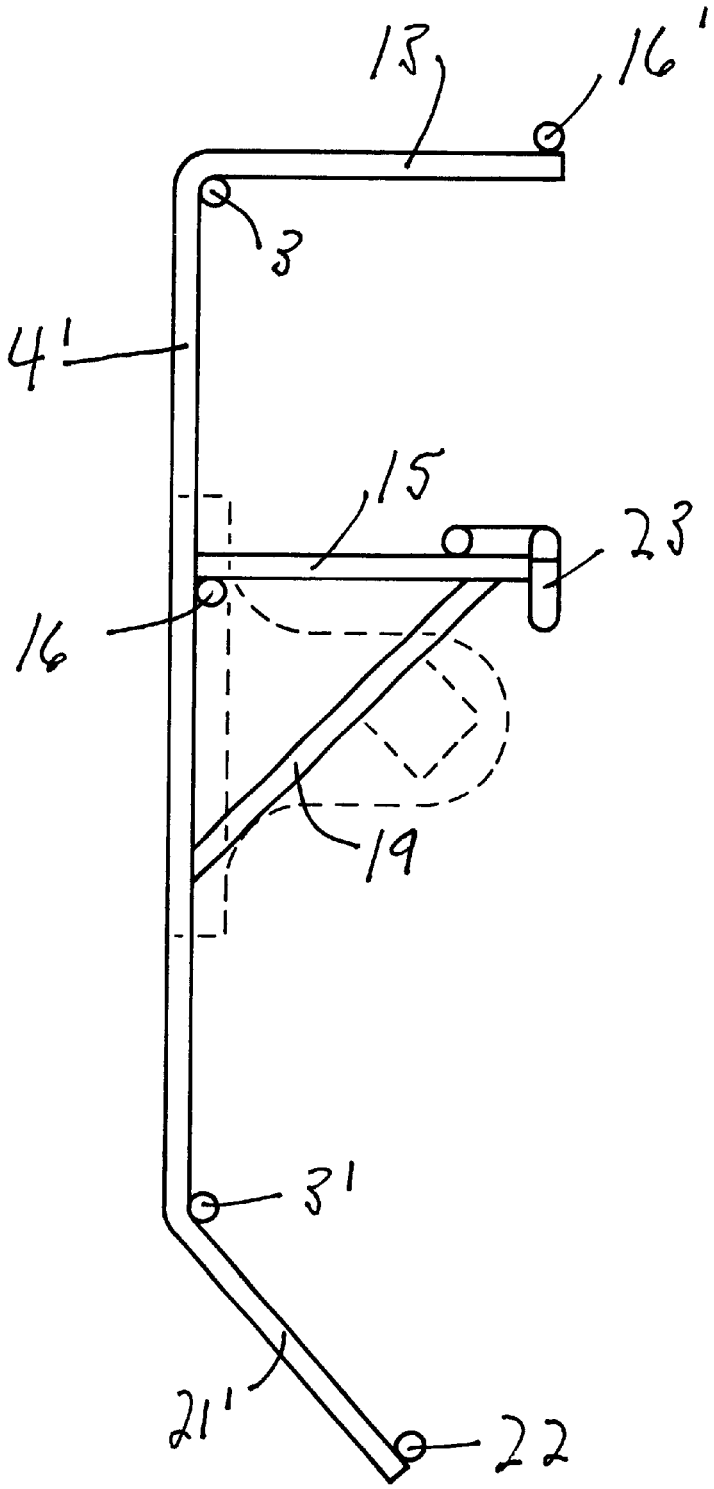
FIG. 2 is a left end view of the accessory shelf unit of this invention as shown in FIG. 1, with the left end of the towel rail shown in phantom lines.

In FIG. 2 is shown a left end view of the shelf unit of this invention, with the various elements as defined in the discussion of FIG. 1. The position of the locking bar 19 in relation to the towel rail (phantom lines) is especially shown in FIG. 2.

Figure 3:
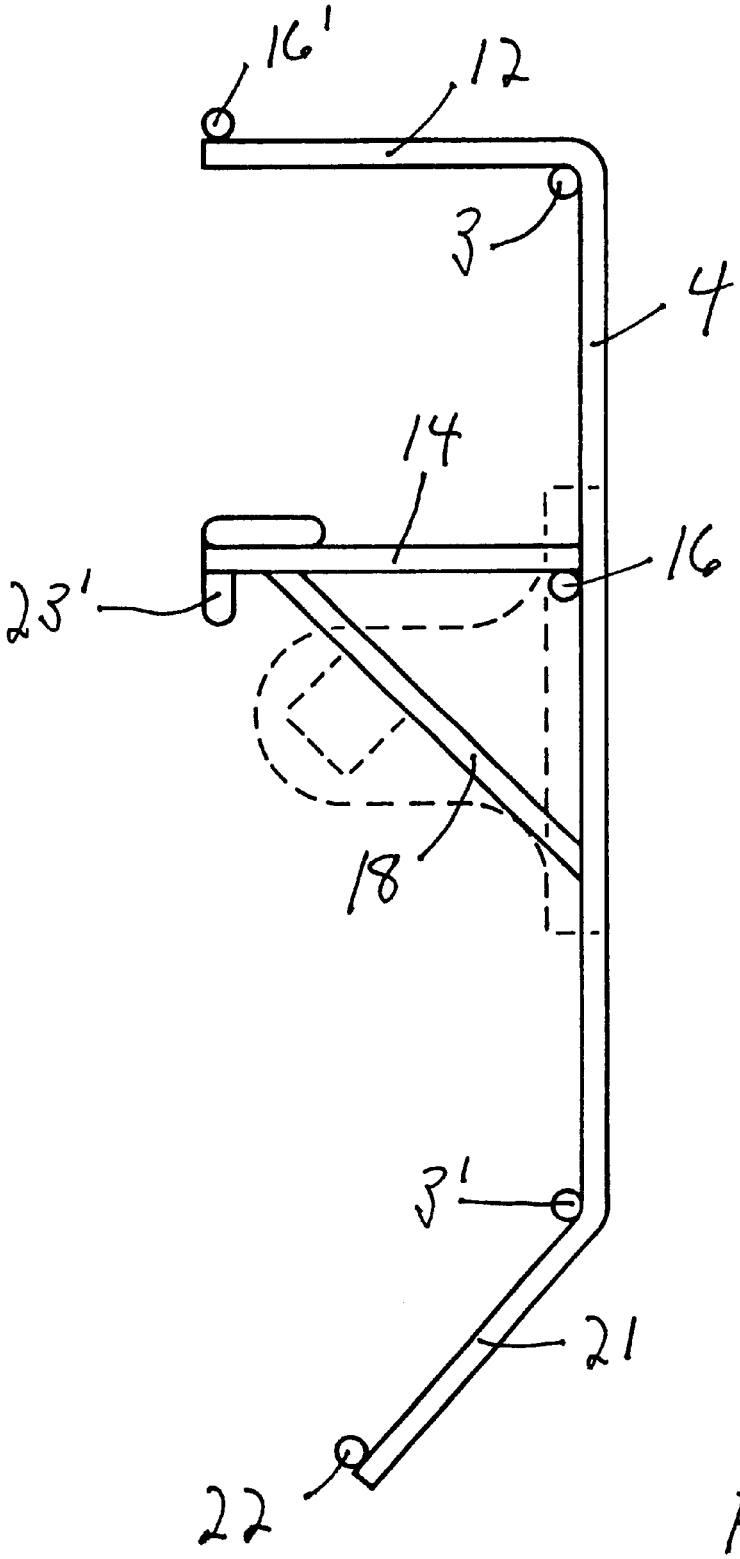
FIG. 3 is a right end view of the accessory shelf unit of this invention as shown in FIG. 1, with the right end of the towel rail shown in phantom lines.

In FIG. 3 is shown a right end view of the shelf unit of this invention, with the various elements as defined in the discussion of FIG. 1. The position of the locking bar 18 in relation to the towel rail (phantom lines) is especially shown in FIG. 3.

While preferably adapted for use in a shower or bath tub area, the shelf unit of this invention can be effectively used where additional space and storage are needed. If used in a shower or bath/shower area, this shelf unit can be installed so that the user does not have to reach through a shower spray to reach the desired object on a shelf. Also, by placement of this shelf unit away from a shower spray, wash cloths can dry more efficiently.

There are many variations and modifications which can be made to the shelf unit of this invention. As examples, more than two shelves can be used; the distance between shelves can be varied, provided that the various items have sufficient space. Additionally, the various angles can be somewhat varied, such as the 45° angles for the locking bars if a round towel rail is used.

The means used to attach the elements to each other can be any of the commonly-used attaching means, such as adhesive, screws, rivets, etc.

The shelf unit of this invention can be constructed of various materials, such as aluminum, steel, plastic, wood, vinyl coated metal, etc. Preferably, either white plastic/vinyl-covered metal or chrome-plated metal is used.

This invention has been described in detail with particular reference to certain embodiments, but variations and modifications can be made without departing from the spirit and scope of the invention as defined in the following claims.

What is claimed is:

1. A three-dimensional shelf unit for use with a substantially horizontally extending towel rail attached to a wall, wherein the unit comprises:

A. a rectangular back portion comprising a plurality of spaced apart horizontal bars and a plurality of spaced apart vertical bars, wherein a first end of each horizontal bar is attached at a substantially 90° angle to a first end of each vertical bar and a second end of each horizontal bar is directly attached at a substantially 90° angle to a second end of each vertical bar, the back portion adapted to be in contact with the wall;

B. at least two shelves, each of which is attached to and extends from the back portion at a substantially 90° angle, wherein the shelves extend away from the back portion and comprise spaced apart bars;

C. at least two locking bars adapted to secure the shelf unit between the towel rail and the wall to which the towel rail is attached and adapted to engage the towel rail at points between the towel rail and the wall, wherein each locking bar is directly attached to and extends from a respective one of the vertical bars at a substantially 45° angle and wherein the locking bars extend away from the back portion; and D. a rectangular bottom portion directly attached to a lowermost portion of the vertical bars and extending from the vertical bars at a substantially 45° angle away from the back portion.

2. A shelf unit as defined by claim 1 wherein the unit is constructed of a material selected from the group consisting of aluminum, steel, plastic, wood, vinyl covered metal, chrome plated metal or a combination thereof.

3. A shelf unit as defined by claim 2 wherein the unit is constructed of vinyl covered metal.

4. A shelf unit as defined by claim 2 wherein the unit is constructed of chrome-plated metal.

5. A shelf unit as defined by claim 1 wherein a first one of the shelves has an opening which is in substantial vertical alignment with a smaller opening in a second one of the shelves located under the first shelf.

6. A shelf unit as defined by claim 1 wherein adhesives, screws or rivets are used to attach the bars and shelves together.

7. A shelf unit as defined by claim 1 wherein the bottom portion is open.

* * * * *